US009303596B2

(12) United States Patent
Na et al.

(10) Patent No.: US 9,303,596 B2
(45) Date of Patent: Apr. 5, 2016

(54) EGR COOLER AND EGR COOLER DEVICE USING THE SAME

(71) Applicant: Hyundai Motor Company, Seoul (KR)

(72) Inventors: Jeonghyun Na, Hwaseong-Si (KR); Eungji Ha, Incheon (KR)

(73) Assignee: Hyundai Motor Company, Seoul (KR)

( * ) Notice: Subject to any disclaimer, the term of this patent is extended or adjusted under 35 U.S.C. 154(b) by 136 days.

(21) Appl. No.: 14/095,456

(22) Filed: Dec. 3, 2013

(65) Prior Publication Data

US 2015/0059716 A1 Mar. 5, 2015

(30) Foreign Application Priority Data

Aug. 30, 2013 (KR) ..... 10-2013-0103793

(51) Int. Cl.
*F02M 25/07* (2006.01)

(52) U.S. Cl.
CPC ..... *F02M 25/0731* (2013.01); *F02M 25/0732* (2013.01); *F02M 25/0737* (2013.01)

(58) Field of Classification Search
CPC ..... F02M 25/0707; F02M 25/07; F02M 25/0728; F02M 25/0735; F02M 25/0734; F02M 25/077; F02M 25/0795
USPC ..... 123/568.12, 568.11, 563, 540, 542
See application file for complete search history.

(56) References Cited

U.S. PATENT DOCUMENTS

| | | | | |
|---|---|---|---|---|
| 6,247,523 | B1 * | 6/2001 | Shibagaki et al. | 165/51 |
| 6,976,480 | B2 * | 12/2005 | Miyoshi et al. | 123/568.12 |
| 7,363,919 | B1 * | 4/2008 | Styles | 123/568.12 |
| 8,225,773 | B2 * | 7/2012 | Gruner et al. | 123/568.12 |
| 8,291,892 | B2 * | 10/2012 | Palanchon et al. | 123/568.12 |
| 2010/0108041 | A1 * | 5/2010 | Gruner et al. | 123/568.12 |

FOREIGN PATENT DOCUMENTS

| | | | |
|---|---|---|---|
| JP | 2003-161209 | A | 6/2003 |
| JP | 2008-88817 | A | 4/2008 |
| JP | 4574425 | B2 | 11/2010 |
| KR | 2003-0018711 | A | 3/2003 |
| KR | 10-2006-0092345 | A | 8/2006 |
| KR | 10-0915346 | B1 | 9/2009 |
| KR | 10-2013-0011243 | A | 1/2013 |
| WO | WO 2012/126654 | A1 | 9/2012 |

OTHER PUBLICATIONS

Machine translation JP2006299942, see "JP2006299942_ MachineTranslation.pdf", dated 2006.*

* cited by examiner

*Primary Examiner* — Lindsay Low
*Assistant Examiner* — Long T Tran
(74) *Attorney, Agent, or Firm* — Morgan, Lewis & Bockius LLP

(57) ABSTRACT

An EGR cooler and an EGR cooler device includes a pre-cooler which is located at a central region at which a cooling water chamber of an EGR cooler housing, in which cooling water circulates, is divided into two spaces, and in which hot exhaust gas introduced from an exhaust system is discharged as primary-cooled exhaust gas via heat-exchange with the cooling water. Therefore, it may be possible to reduce costs by a decrease in number of EGR tubes via optimal primary cooling performance for the exhaust gas in the pre-cooler and particularly to relieve damage by a thermal load generated due to the hot exhaust gas by fully surrounding an inlet and an outlet of the pre-cooler with the circulating cooling water.

13 Claims, 6 Drawing Sheets

EGR COOLER AND EGR COOLER DEVICE USING THE SAME

CROSS-REFERENCE TO RELATED APPLICATIONS

The present application claims priority of Korean Patent Application Number 10-2013-0103793, filed Aug. 30, 2013, the entire contents of which application is incorporated herein for all purposes by this reference.

BACKGROUND OF INVENTION

1. Field of Invention

The present invention relates to an EGR cooler; and, particularly, to an EGR cooler and an EGR cooler device using the same capable of relieving a thermal load generated due to hot exhaust gas and simultaneously reducing costs by a decrease in number of EGR tubes via cooling performance enhancement by placing a pre-cooler in a central space of the EGR cooler such that the pre-cooler is surrounded with cooling water circulating in an inner space of the EGR cooler.

2. Description of Related Art

In general, an Exhaust Gas Recirculation (EGR) cooler is included in an EGR system which serves to decrease harmful ingredients such as CO, HC, and NOx (nitrogen oxides) contained in exhaust gas.

Such an EGR cooler serves to convert hot exhaust gas into EGR gas as cold exhaust gas having a relatively lower temperature using cooling water.

As an example, the EGR cooler introduces exhaust gas having a high temperature of about 600° C. and performs heat-exchange between the exhaust gas and the cooling water, thereby allowing the exhaust gas to be converted into EGR gas having a low temperature of about 140° C.

However, if the temperature of the exhaust gas is increased, a generation amount of NOx is gradually increased. Accordingly, there is a need for a measure to more efficiently lower the temperature of the exhaust gas in the EGR cooler. A pre-cooler may be exemplified as the EGR cooler having improved performance so as to more efficiently lower the temperature of the hot exhaust gas.

This pre-cooler allows the introduced hot exhaust gas to be formed at a temperature lower by two levels than that thereof using the cooling water, thereby enabling the temperature of the EGR gas emitted from the EGR cooler to be converted into a much lower temperature.

However, the pre-cooler is configured by an aluminum body and integrated into the EGR cooler, so that the EGR cooler has a structural limit due to the pre-cooler.

As an example of such influence, when the pre-cooler has insufficient cooling performance, the EGR cooler is subject to a thermal load by introduction of the hot exhaust gas into the pre-cooler and the thermal load of the EGR cooler generates a crack in the EGR cooler.

As another example of such influence, there is a case in which an EGR valve connected to the EGR cooler is subject to a thermal load by the hot exhaust gas emitted from the pre-cooler. In this case, after the exhaust gas emitted from the pre-cooler is first introduced into the EGR valve, the exhaust gas is discharged from the EGR valve and then introduced into the EGR cooler again. Consequently, the thermal load due to the hot exhaust gas emitted from the pre-cooler increases damage to an electronic control circuit of the EGR valve and wear of a valve rotation portion.

Particularly, if the temperature of the exhaust gas emitted from the pre-cooler exceeds a critical temperature of the EGR valve, damage due to the thermal load cannot help but increase in the EGR valve.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for an EGR cooler and an EGR cooler device using the same that an inner space surrounded with circulating cooling water is divided into two spaces in which EGR tubes are respectively located, and a pre-cooler is located on a part at which the two spaces are divided. Consequently, it may be possible to reduce costs by a decrease in number of the EGR tubes via optimal primary cooling performance for exhaust gas in the pre-cooler and particularly to relieve a thermal load generated due to hot exhaust gas by fully surrounding an inlet and an outlet of the pre-cooler with the circulating cooling water.

Various aspects of the present invention provide for an EGR cooler includes an EGR cooler housing defined with a cooling water chamber in which cooling water circulates in such a way to be introduced from the outside and then discharged to the outside, a pre-cooler defining a space blocked from the cooling water such that hot exhaust gas introduced from an exhaust system is discharged as primary-cooled exhaust gas via heat-exchange with the cooling water, the pre-cooler being located at a central region at which the cooling water chamber is divided into two upper and lower spaces, and an EGR tube including an upper EGR tube and a lower EGR tube which are respectively located in the upper and lower spaces divided by the pre-cooler, and in which the primary-cooled exhaust gas is converted into secondary-cooled EGR gas via heat-exchange with the cooling water.

A flow direction in which the hot exhaust gas introduced into the pre-cooler is converted into the primary-cooled exhaust gas and then discharged from the pre-cooler may be the same as a flow direction of the cooling water, and a flow direction in which the primary-cooled exhaust gas introduced into each of the upper and lower EGR tubes is converted into the secondary-cooled EGR gas may be opposite to the flow direction of the cooling water.

The EGR tube may include the upper EGR tube and the lower EGR tube which are respectively located in one side space and the other side space divided by the pre-cooler.

Each of the upper and lower EGR tubes may discharge the EGR gas, the EGR cooler housing may include a first EGR gas outlet port through which the EGR gas emitted from the upper EGR tube is discharged and a second EGR gas outlet port through which the EGR gas emitted from the lower EGR tube is discharged, the first EGR gas outlet port may be located above the pre-cooler, and the second EGR gas outlet port may be located below the pre-cooler.

The pre-cooler may include an exhaust gas tube located and sealed at the central region at which the cooling water chamber is divided into two spaces so as to be surrounded with the cooling water, an exhaust gas inlet port through which the hot exhaust gas is introduced into the exhaust gas tube, and an exhaust gas outlet port through which the primary-cooled exhaust gas is discharged from the exhaust gas tube.

The primary-cooled exhaust gas emitted from exhaust gas outlet port may be introduced into each of the upper and lower EGR tubes.

The upper EGR tube may include three tubes, the primary-cooled exhaust gas flowing in each of the three tubes, baffles which fix the three tubes in a state of being spaced by a certain distance, and a nozzle to collect the EGR gas emitted from each of the three tubes, and the lower EGR tube may include three tubes, the primary-cooled exhaust gas flowing in each of the three tubes, baffles which fix the three tubes in a state of being spaced by a certain distance, and a nozzle to collect the EGR gas emitted from each of the three tubes.

The upper and lower EGR tubes may be coupled with a valve connector fastened to the EGR cooler housing, the nozzle of the upper EGR tube may be connected to the first EGR gas outlet port of the EGR cooler housing, and the nozzle of the lower EGR tube may be connected to the second EGR gas outlet port of the EGR cooler housing.

Various aspects of the present invention provide for an EGR cooler device that includes an EGR cooler including an EGR cooler housing within which cooling water circulates, a pre-cooler located at a central region at which an inner space of the EGR cooler housing is divided into two upper and lower spaces such that hot exhaust gas introduced from an exhaust system is primary-cooled via heat-exchange with the cooling water, and a pair of an upper EGR tube and a lower EGR tube, the primary-cooled exhaust gas flowing in each of the upper EGR tube and the lower EGR tube so as to be converted into secondary-cooled EGR gas via heat-exchange with the cooling water, and an EGR valve which connects the pre-cooler to the EGR cooler such that the primary-cooled exhaust gas by the pre-cooler is introduced into the EGR valve and distributed to each of the upper EGR tube and the lower EGR tube.

The EGR cooler housing may include a first EGR gas outlet port which is connected with the upper EGR tube and through which the EGR gas is discharged, and a second EGR gas outlet port which is connected with the lower EGR tube and through which the EGR gas is discharged.

The EGR valve may include a valve inlet port which is connected to the pre-cooler and through which the primary-cooled exhaust gas is introduced, a first valve outlet port which divides at the valve inlet port and through which the primary-cooled exhaust gas is transferred to the upper EGR tube, and a second valve outlet port which divides at the valve inlet port and through which the primary-cooled exhaust gas is transferred to the lower EGR tube.

The EGR valve and the upper and lower EGR tubes may be coupled with a valve connector, and the valve connector may be fastened to the EGR cooler housing.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1A:
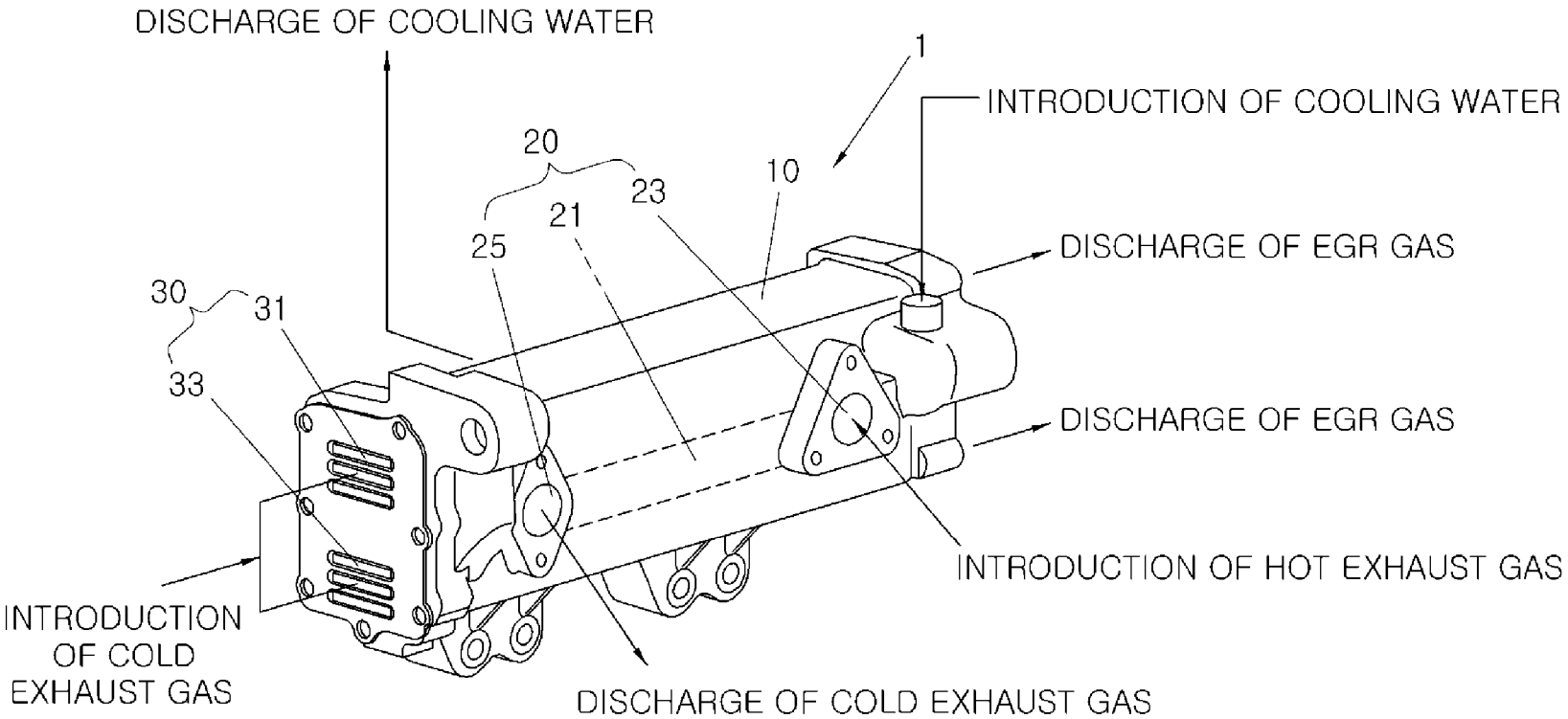
FIGS. 1A and 1B are a view illustrating a configuration of an exemplary EGR cooler in accordance with the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Throughout the disclosure, like reference numerals refer to like parts throughout the various figures and various embodiments of the present invention.

Figure 1B:
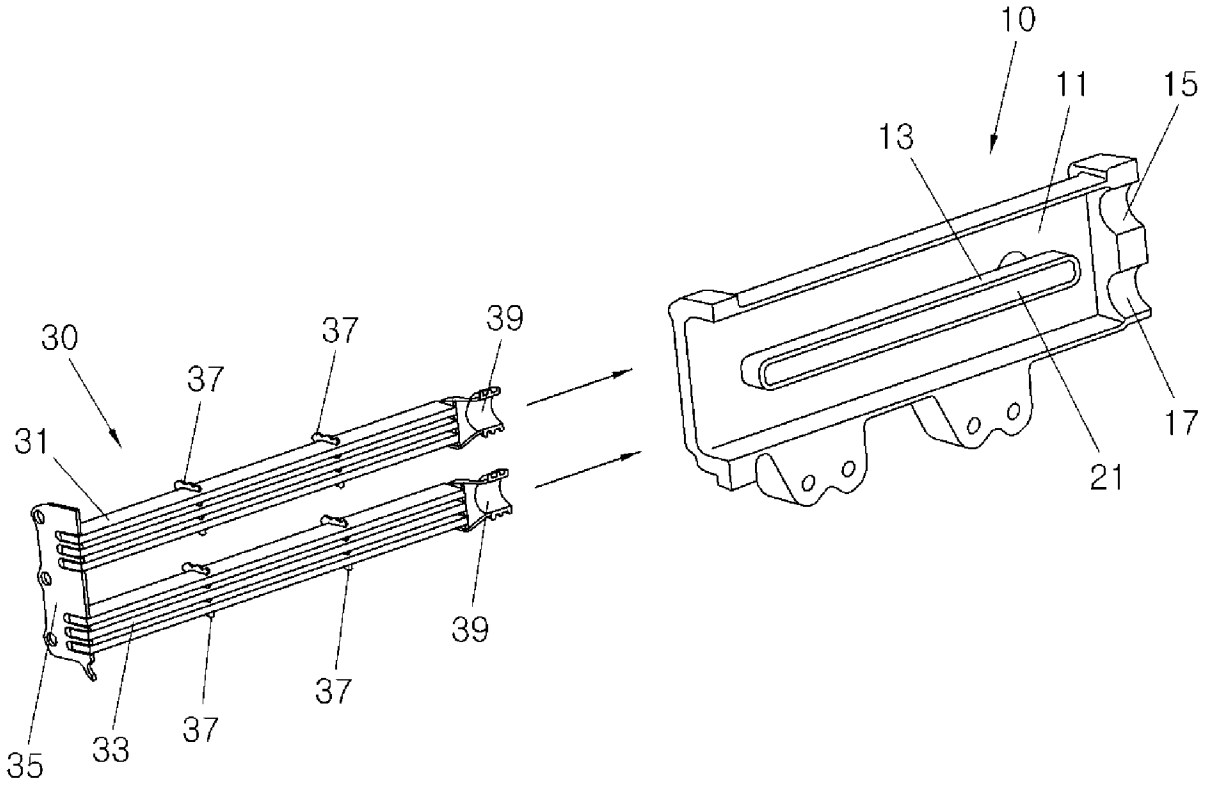

FIGS. 1A and 1B are a view illustrating a configuration of an EGR cooler in accordance with various embodiments of the present invention.

As shown in FIG. 1A, the EGR cooler 1 includes an EGR cooler housing 10 which is made of an aluminum material and within which cooling water circulates, a pre-cooler 20 which converts hot exhaust gas into cold exhaust gas having a relatively lower temperature by primary cooling of the hot exhaust gas using the cooling water circulating within the EGR cooler housing 10, and an EGR tube 30 which converts the cold exhaust gas discharged from the pre-cooler 20 into EGR gas by secondary cooling of the cold exhaust gas using the cooling water circulating within the EGR cooler housing 10.

The pre-cooler 20 includes an exhaust gas tube 21 located at a central region of the EGR cooler housing 10 so as to be surrounded with the cooling water circulating within the EGR cooler housing 10, an exhaust gas inlet port 23 through which the hot exhaust gas emitted from an engine to an exhaust system is introduced into the exhaust gas tube 21, and an exhaust gas outlet port 25 through which the cold exhaust gas cooled in the exhaust gas tube 21 is discharged.

In various embodiments, the pre-cooler 20 has cooling performance via which the temperature of the exhaust gas is lowered but does not exceed a critical temperature for smooth operation of an EGR valve (to be described in detail below) connected with the EGR cooler 1. Therefore, a target temperature of the EGR gas is designed to be adjusted in such a manner that the cold exhaust gas emitted from the pre-cooler 20 is introduced through the EGR valve into the EGR cooler 1 and is then cooled by the cooling water in the EGR cooler 1.

Meanwhile, FIG. 1B illustrates configurations of the EGR cooler housing 10 and the EGR tube 30.

The EGR cooler housing 10 is defined with a cooling water chamber 11 as a space in which the cooling water circulates in such a way to be introduced from the outside and be then discharged to the outside again. A pre-cooler chamber 13 surrounded and enclosed by the cooling water is located at a central region of the cooling water chamber 11 so that the space of the cooling water chamber 11 is divided into a region above and a region below the pre-cooler chamber 13.

However, since the space of the cooling water chamber 11 is not fully separated by the pre-cooler chamber 13, the cooling water introduced into the cooling water chamber 11 is not divided into the upper flow and the lower flow by the pre-cooler chamber 13.

In addition, the EGR cooler housing 10 is formed an EGR gas outlet communicating with the cooling water chamber 11, and the EGR gas outlet is configured of a first EGR gas outlet port 15 and a second EGR gas outlet port 17.

The first EGR gas outlet port 15 is located above the pre-cooler chamber 13 dividing the cooling water chamber 11 into the both regions, whereas the second EGR gas outlet port 17 is located below the pre-cooler chamber 13.

The EGR tube 30 includes an upper EGR tube 31 configured by a bundle of at least three tubes through which the exhaust gas flows and a lower EGR tube 33 configured by a bundle of at least three tubes through which the exhaust gas flows.

Accordingly, the upper EGR tube 31 is located above the pre-cooler chamber 13 dividing the cooling water chamber 11 into the both regions, whereas the lower EGR tube 33 is located below the pre-cooler chamber 13 the cooling water chamber 11 into the both regions.

Consequently, the upper EGR tube 31 and the lower EGR tube 33 may be respectively configured by two bundles of three tubes formed as six tubes. As a result, it may be possible to reduce costs due to these six tubes, compared with the number of seven tubes required when one EGR tube 30 is configured.

Furthermore, the EGR tube 30 further includes a valve connector 35 connected to both of the upper EGR tube 31 and the lower EGR tube 33, and at least one baffle 37 which is coupled to each of the upper EGR tube 31 and the lower EGR tube 33 in order to support the bundle of tubes and guide the flow of the cooling water in the cooling water chamber 11.

Particularly, the baffles 37 serve to fix three tubes in a state of being spaced by a certain distance.

In addition, the upper and lower EGR tubes 31 and 33 are respectively provided with nozzles 39, and the nozzles 39 are respectively located at the first and second EGR gas outlet ports 15 and 17 of the EGR cooler housing 10.

Accordingly, the cooled exhaust gas emitted from the upper EGR tube 31 passes through the nozzle 39 and is discharged through the first EGR gas outlet port 15 such that the exhaust gas is discharged as EGR gas, and the cooled exhaust gas emitted from the lower EGR tube 33 passes through the nozzle 39 and is discharged through the second EGR gas outlet port 17 such that the exhaust gas is discharged as EGR gas. As a result, the EGR gas may be double discharged from the EGR cooler housing 10.

Figure 2:
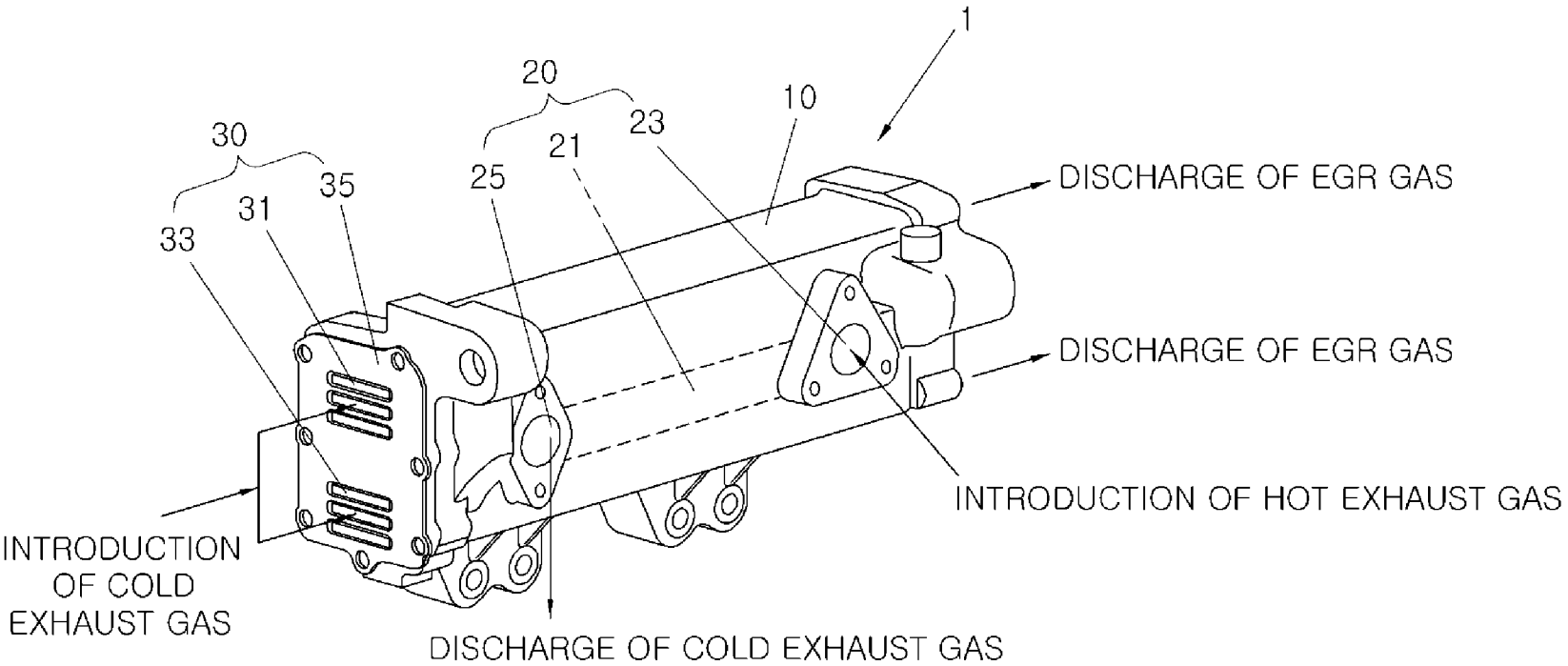
FIGS. 2 and 3 are a view illustrating the flow of exhaust gas using a pre-cooler included in an exemplary EGR cooler in accordance with the present invention.
Figure 3:
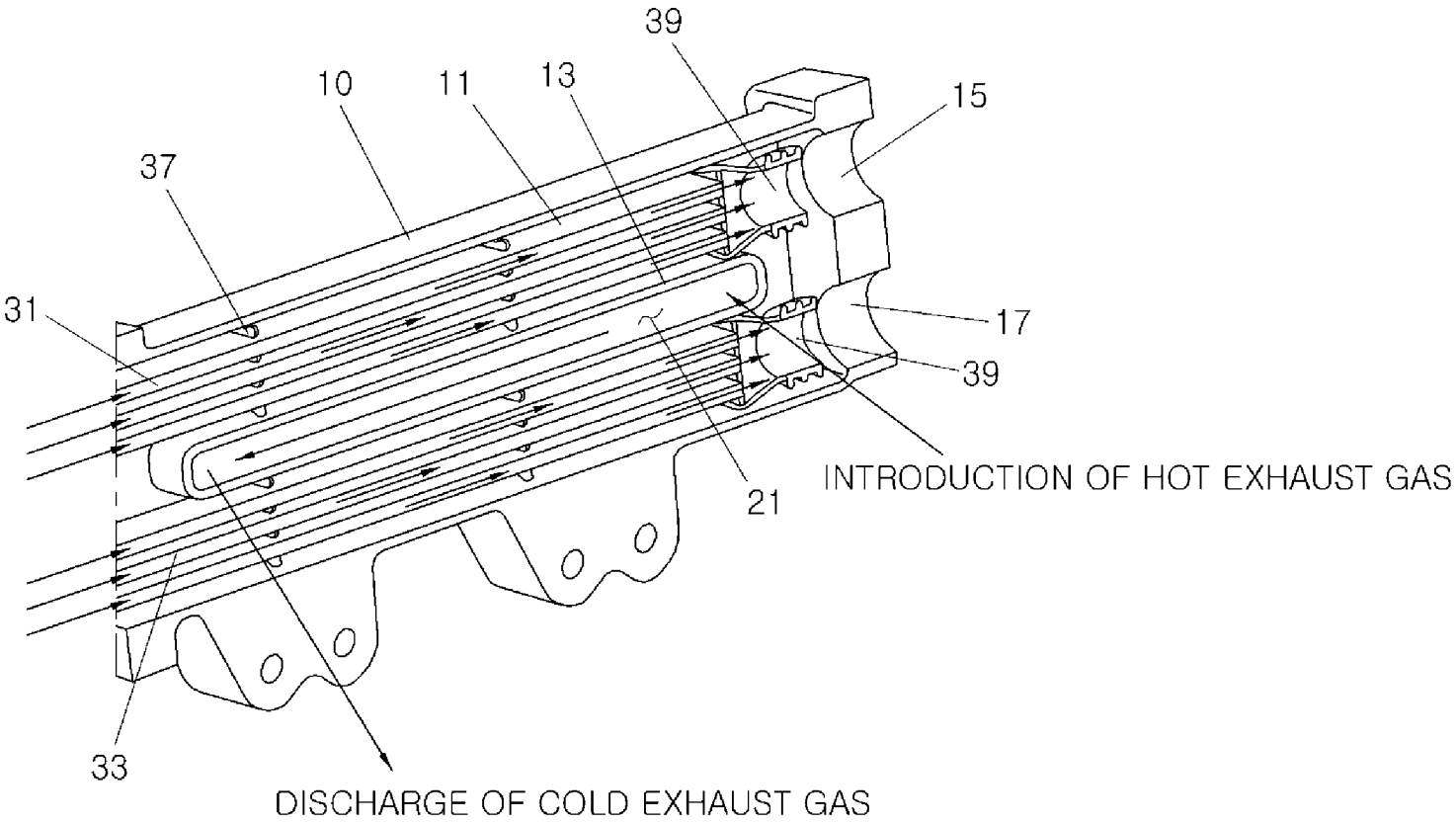

Meanwhile, FIGS. 2 and 3 illustrate the flow of the exhaust gas between the pre-cooler 20 and the EGR tube 30.

As shown in the drawing, the hot exhaust gas emitted from the engine to the exhaust system is introduced into the exhaust gas inlet port 23 formed at one side end of the exhaust gas tube 21, discharged from the exhaust gas inlet port 23, and introduced into the exhaust gas tube 21 surrounded with the cooling water circulating in the cooling water chamber 11 of the EGR cooler housing 10.

The hot exhaust gas introduced into the exhaust gas tube 21 is converted into the cold exhaust gas via heat-exchange with the cooling water surrounding the exhaust gas tube 21, and is then discharged from the exhaust gas tube 21 through the exhaust gas outlet port 25 formed at the other side end of the exhaust gas tube 21.

In this case, the cold exhaust gas emitted from the exhaust gas outlet port 25 is cooled at a temperature which does not exceed the critical temperature of the EGR valve.

Subsequently, the cold exhaust gas emitted from the exhaust gas outlet port 25 is divided into the flow passing through the upper EGR tube 31 and the flow passing through the lower EGR tube 33 via the EGR valve (to be described in detail below) connected with the pre-cooler 20, thereby passing through the EGR cooler housing 10.

In this case, the cooling water in the cooling water chamber 11 is guided by action of the plural baffles 37 provided in the respective upper and lower EGR tubes 31 and 33.

In this process, the exhaust gas flowing in each of the upper and lower EGR tubes 31 and 33 is heat-exchanged with the cooling water in the EGR cooler housing 10. Consequently, the temperature of the exhaust gas is much lowered and finally adjusted to a target temperature of the EGR gas.

Subsequently, the exhaust gas emitted from the upper EGR tube 31 is discharged as EGR gas through the first EGR gas outlet port 15 connected with the nozzle 39 of the upper EGR tube 31, and, at the same time, the exhaust gas emitted from the lower EGR tube 33 is discharged as EGR gas through the second EGR gas outlet port 17 connected with the nozzle 39 of the lower EGR tube 33.

The EGR cooler 1 according to various embodiments use six EGR tubes. Nevertheless, it is experimentally identified that the EGR cooler 1 has cooling performance equal to that when seven EGR tubes are used and the temperature of the EGR cooler housing 10 made of an aluminum material is particularly lowered to a level of about 30-35%.

Particularly, in various embodiments, a flow direction in which the hot exhaust gas introduced into the pre-cooler is converted into primary-cooled exhaust gas and then discharged from the pre-cooler is the same as the flow direction of the cooling water, and a flow direction in which the primary-cooled exhaust gas introduced into each of the upper and lower EGR tubes is converted into secondary-cooled EGR gas is opposite to the flow direction of the cooling water.

Figure 4:
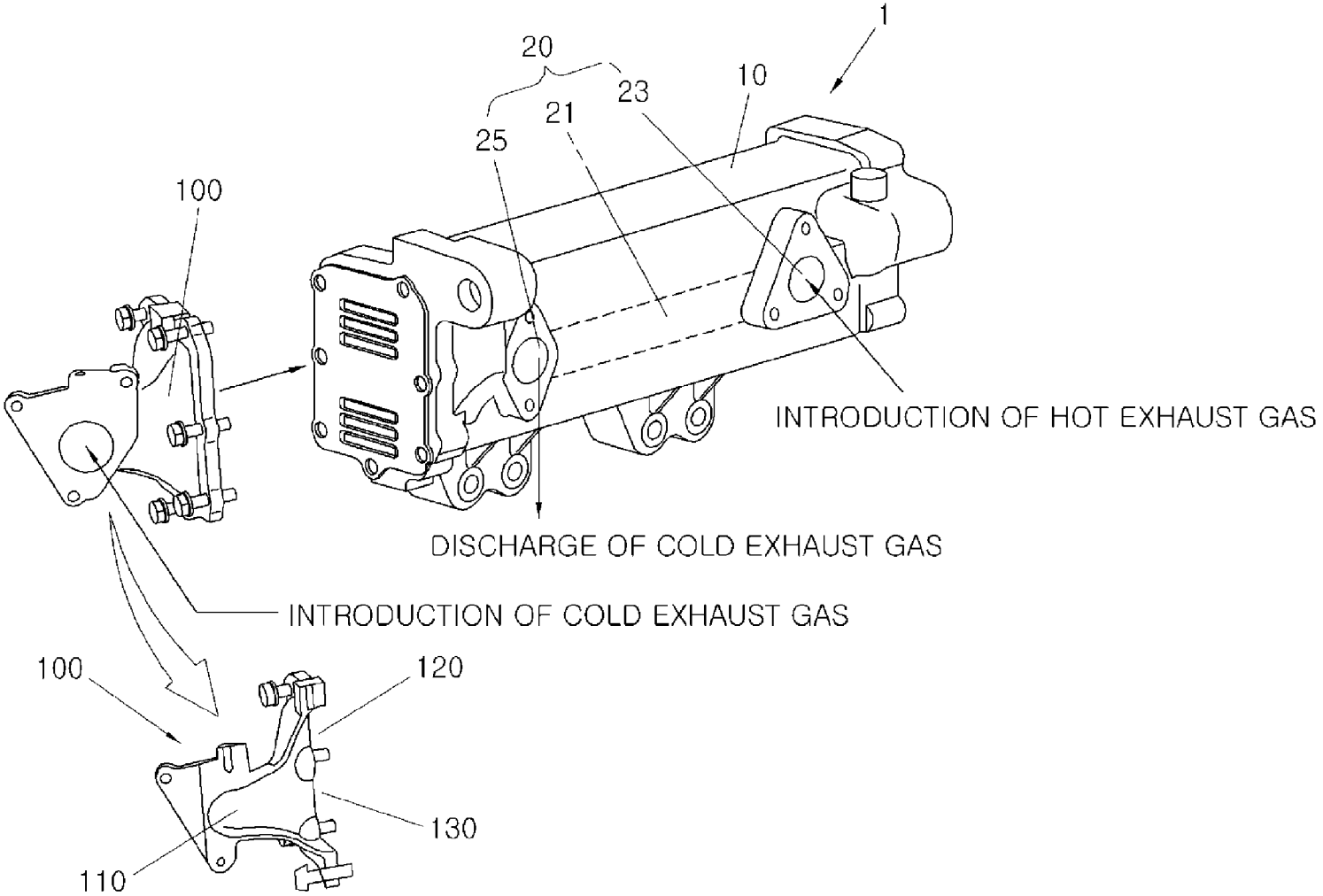
FIG. 4 is a view illustrating a configuration of an exemplary EGR cooler device connected with an EGR valve in accordance with the present invention.

Meanwhile, FIG. 4 illustrates a configuration of an EGR cooler device connected with an EGR valve in accordance with various embodiments of the present invention.

As shown in the drawing, the EGR cooler device includes an EGR cooler 1 including an EGR cooler housing 10 which is made of an aluminum material and within which cooling water circulates, a pre-cooler 20 located at a central region of the EGR cooler housing 10 at which an inner space of the EGR cooler housing 10 is divided into two spaces and primarily cooling hot exhaust gas, and an EGR tube 30 configured by a pair of an upper EGR tube 31 and a lower EGR tube 33 such that exhaust gas flows in each of the upper EGR tube 31 and a lower EGR tube 33 and converting the primary-cooled exhaust gas by the pre-cooler 20 into EGR gas by secondarily cooling the primary-cooled exhaust gas using the cooling water in the EGR cooler housing 10; and an EGR valve 100 which connects the pre-cooler 20 to the EGR cooler 1 such that the primary-cooled exhaust gas by the pre-cooler 20 is introduced into the EGR valve 100 and distributed to each of the upper EGR tube 31 and the lower EGR tube 33.

The EGR cooler 1 is the same as the above-mentioned EGR cooler 1 in FIGS. 1A, 1B, 2 and 3.

The EGR valve 100 includes a valve inlet port 110 connected to the exhaust gas outlet port 25 of the pre-cooler 20, a first valve outlet port 120 which divides at the valve inlet port 110 to be connected to the upper EGR tube 31, and a second valve outlet port 130 which divides at the valve inlet port 110 to be connected to the lower EGR tube 33.

In various embodiments, the EGR valve 100 has a configuration, operation, and control similar to the typical EGR valve.

Figure 5:
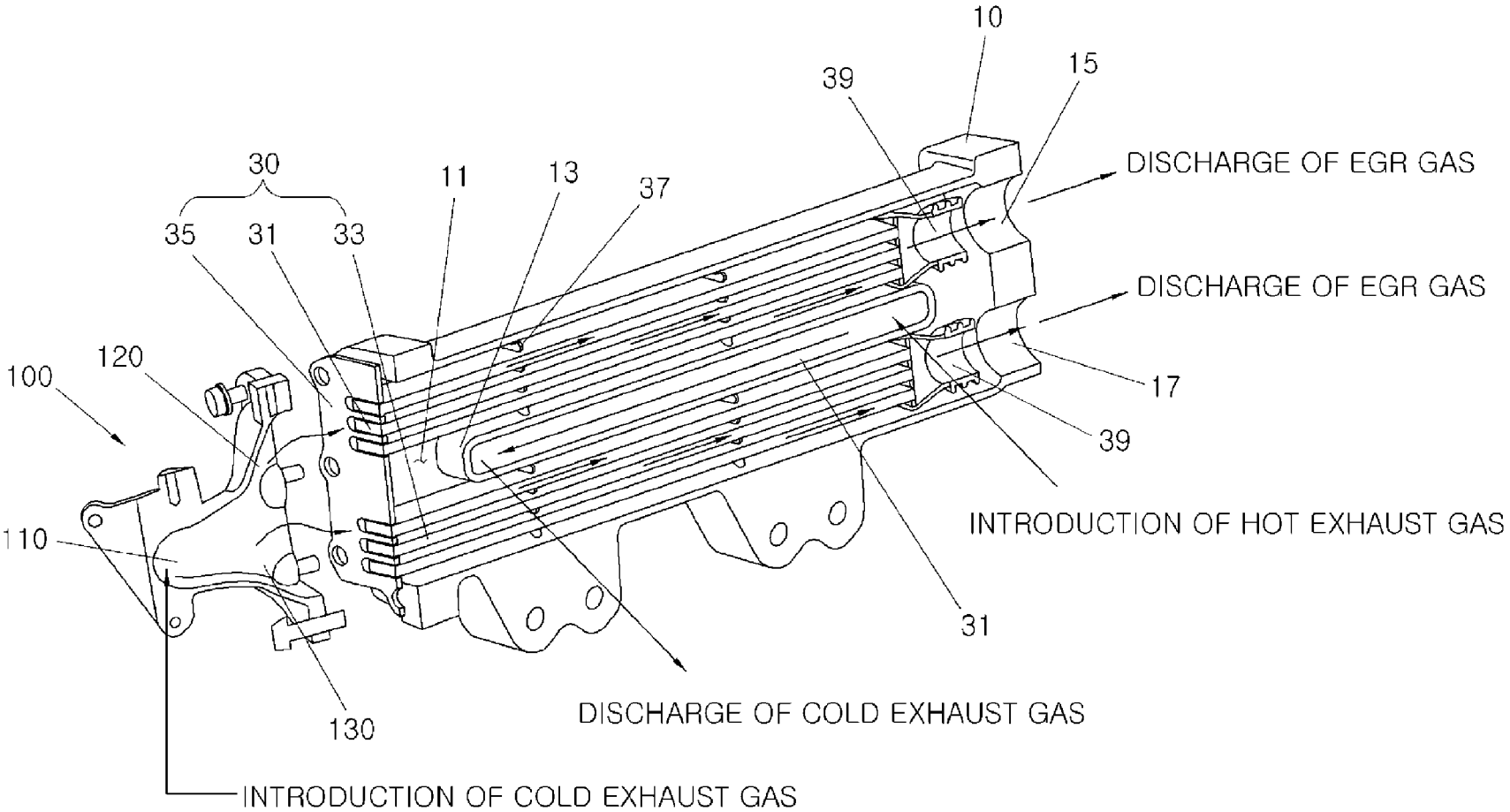
FIG. 5 is a view illustrating the flow of EGR gas circulating through an exemplary pre-cooler, an exemplary EGR valve, and an exemplary EGR cooler in accordance with the present invention.

Meanwhile, FIG. 5 illustrates the flow of the EGR gas between the EGR cooler 1 and the EGR valve 100 in accordance with various embodiments.

As shown in the drawing, the hot exhaust gas emitted from the engine to the exhaust system is introduced into the pre-cooler 20 included in the EGR cooler 1, primary-cooled by the cooling water circulating within the EGR cooler housing 10, and then discharged from the pre-cooler 20. In this case, the temperature of the primary-cooled exhaust gas by the pre-cooler 20 does not exceed a critical temperature of the EGR valve 100.

Subsequently, the primary-cooled exhaust gas emitted from the pre-cooler 20 is introduced into the EGR valve 100 connected to the exhaust gas outlet port 25 of the pre-cooler 20, and the primary-cooled exhaust gas introduced through the first and second valve outlet ports 120 and 130 is divided into two flows by the EGR valve 100.

Thus, the primary-cooled exhaust gas emitted from the first valve outlet port 120 is introduced into the upper EGR tube 31, and, at the same time, the primary-cooled exhaust gas emitted from the second valve outlet port 130 is introduced into the lower EGR tube 33.

Then, the exhaust gas flowing in each of the upper and lower EGR tubes 31 and 33 is secondary-cooled via heat-exchange with the cooling water in the EGR cooler housing 10. As a result, the temperature of the exhaust gas is lowered to a target temperature of the EGR gas via the secondary cooling.

Subsequently, the exhaust gas emitted from the upper EGR tube 31 is discharged as EGR gas through the first EGR gas outlet port 15 connected with the nozzle 39 of the upper EGR tube 31, and, at the same time, the exhaust gas emitted from the lower EGR tube 33 is discharged as EGR gas through the second EGR gas outlet port 17 connected with the nozzle 39 of the lower EGR tube 33.

In the EGR cooler device according to various embodiments, it is experimentally identified that the temperature of a region with which the EGR valve 100 comes into contact is significantly lowered due to superior cooling performance of the exhaust gas by the pre-cooler 20, thereby greatly enhancing operational durability of the EGR valve 100.

As described above, the EGR cooler 1 according to various embodiments includes the pre-cooler 20 located at the central region at which the cooling water chamber 11 of the EGR cooler housing 10, in which the cooling water circulates, is divided into two spaces and in which the hot exhaust gas introduced from the exhaust system is discharged as the primary-cooled exhaust gas via heat-exchange with the cooling water. Therefore, it may be possible to reduce costs by a decrease in number of the EGR tubes via optimal primary cooling performance for the exhaust gas in the pre-cooler 20 and particularly to relieve damage by a thermal load generated due to the hot exhaust gas by fully surrounding the inlet and the outlet of the pre-cooler 20 with the circulating cooling water.

In accordance with various embodiments of the present invention, since a pre-cooler is located in a central space within an EGR cooler and surrounded with circulating cooling water, primary cooling performance for exhaust gas in the pre-cooler may be significantly increased.

In addition, in accordance with various embodiments of the present invention, it may be possible to relieve the impact of a thermal load on the EGR cooler by the hot exhaust gas introduced into the pre-cooler. Therefore, although the EGR cooler is made of an aluminum material which is easily deformed by heat, no crack is generated in the EGR cooler.

In addition, in accordance with various embodiments of the present invention, since the exhaust gas introduced into EGR tubes is primary-cooled at a sufficiently lower temperature by the pre-cooler, the same performance may be maintained even at the time of a decrease in number of the EGR tubes which converts the exhaust gas into EGR gas by secondary cooling thereof. Particularly, it may be possible to reduce costs due to a decrease in number of the EGR tubes configuring most of material costs in the EGR cooler.

Furthermore, in accordance with various embodiments of the present invention, since an EGR valve to control a flow rate of the exhaust gas which is discharged from the pre-cooler and introduced into the EGR cooler again is configured together with the EGR cooler in which the pre-cooler surrounded with the circulating cooling water is located in the central space within the EGR cooler, it may be possible to relieve the bad impact of a thermal load on the EGR valve by primary cooling exhaust gas in the pre-cooler and particularly to prevent damage to an electronic control circuit of the EGR valve and wear of a valve rotation portion by significantly decreasing the impact of the thermal load, thereby enabling enhancement of durability.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exhaust gas recirculation (EGR) cooler comprising:

an EGR cooler housing including a cooling water chamber in which a cooling water circulates, introduced from outside of the EGR cooler housing and then discharged to the outside thereof;

a pre-cooler in which a hot exhaust gas introduced from an exhaust system is discharged as primary-cooled exhaust gas via heat-exchange with the cooling water, the pre-cooler including a space blocked from the cooling water, the pre-cooler being located at a central region at which the cooling water chamber is divided into two upper and lower spaces; and an EGR tube including an upper EGR tube and a lower EGR tube which are respectively located in the upper and lower spaces divided by the pre-cooler, and in which the primary-cooled exhaust gas is converted into secondary-cooled EGR gas via heat-exchange with the cooling water in each of the upper EGR tube and the lower EGR tube, wherein the EGR cooler housing further includes a pre-cooler chamber surrounded and enclosed by the cooling water and sealed from the cooling water, the pre-cooler located at the central region of the cooling water chamber so that the space of the cooling water chamber is divided into the upper space and the lower space below the pre-cooler chamber.

2. The EGR cooler of claim 1, wherein:

a flow direction in which the hot exhaust gas introduced into the pre-cooler is converted into the primary-cooled exhaust gas and then discharged from the pre-cooler, is the same as a flow direction of the cooling water; and a flow direction in which the primary-cooled exhaust gas introduced into each of the upper and lower EGR tubes is converted into the secondary-cooled EGR gas, is opposite to the flow direction of the cooling water.

3. The EGR cooler of claim 1, wherein each of the upper and lower EGR tubes discharges the EGR gas, and the EGR cooler housing includes a first EGR gas outlet port through which the EGR gas emitted from the upper EGR tube is discharged and a second EGR gas outlet port through which the EGR gas emitted from the lower EGR tube is discharged.

4. The EGR cooler of claim 1, wherein the pre-cooler comprises an exhaust gas tube located and sealed at the central region at which the cooling water chamber is divided into two upper and lower spaces so as to be surrounded with the cooling water, an exhaust gas inlet port through which the hot exhaust gas is introduced into the exhaust gas tube, and an exhaust gas outlet port through which the primary-cooled exhaust gas is discharged from the exhaust gas tube.

5. The EGR cooler of claim 4, wherein the primary-cooled exhaust gas emitted from the exhaust gas outlet port is introduced into each of the upper and lower EGR tubes.

6. The EGR cooler of claim 1, wherein:

the upper EGR tube includes a first population of three tubes, the primary-cooled exhaust gas flowing in each member of the first population of three tubes, first baffles which fix the first population of three tubes spaced between the first baffles and a first nozzle to collect the EGR gas emitted from each member of the first population of three tubes; and the lower EGR tube includes a second population of three tubes, the primary-cooled exhaust gas flowing in each member of the second population of three tubes, second baffles which fix the second population of three tubes spaced between the second baffles, and a second nozzle to collect the EGR gas emitted from each member of the second population of three tubes.

7. The EGR cooler of claim 6, wherein the upper and lower EGR tubes are coupled with a valve connector fastened to the EGR cooler housing, the first nozzle of the upper EGR tube is connected to the first EGR gas outlet port of the EGR cooler housing, and the second nozzle of the lower EGR tube is connected to the second EGR gas outlet port of the EGR cooler housing.

8. The EGR cooler device of claim 1, wherein the pre-cooler chamber includes an exhaust gas tube therein and configured to receive exhaust gas in the exhaust gas tube.

9. An exhaust gas recirculation (EGR) cooler device comprising:

an EGR cooler including an EGR cooler housing within which cooling water circulates, a pre-cooler located at a central region at which an inner space of the EGR cooler housing is divided into two upper and lower spaces such that hot exhaust gas introduced from an exhaust system is cooled via heat-exchange with the cooling water, and an upper EGR tube and a lower EGR tube, the primary-cooled exhaust gas flowing in each of the upper EGR tube and the lower EGR tube so as to be converted into secondary-cooled EGR gas via heat-exchange with the cooling water; and an EGR valve which connects the pre-cooler to the EGR cooler such that the cooled exhaust gas by the pre-cooler is introduced into the EGR valve and distributed to each of the upper EGR tube and the lower EGR tube, wherein the EGR cooler housing further includes a pre-cooler chamber surrounded and enclosed by the cooling water and sealed from the cooling water, the pre-cooler chamber located at the central region of the EGR cooler housing so that an inner space of the EGR cooler housing is divided into an upper space and a lower space below the pre-cooler chamber.

10. The EGR cooler device of claim 9, wherein the EGR cooler housing comprises:

a first EGR gas outlet port which is connected with the upper EGR tube and through which the EGR gas is discharged; and a second EGR gas outlet port which is connected with the lower EGR tube and through which the EGR gas is discharged.

11. The EGR cooler device of claim 9, wherein the EGR valve comprises:

a valve inlet port which is connected to the pre-cooler and through which the primary-cooled exhaust gas is introduced;

a first valve outlet port which divides at the valve inlet port and through which the primary-cooled exhaust gas is transferred to the upper EGR tube; and a second valve outlet port which divides at the valve inlet port and through which the primary-cooled exhaust gas is transferred to the lower EGR tube.

12. The EGR cooler device of claim 9, wherein the EGR valve and the upper and lower EGR tubes are coupled with a valve connector, and the valve connector is fastened to the EGR cooler housing.

13. The EGR cooler device of claim 9, wherein the pre-cooler chamber includes an exhaust gas tube therein and configured to receive exhaust gas in the exhaust gas tube.

* * * * *